United States Patent [19]

Hard

[11] 4,241,951

[45] Dec. 30, 1980

[54] RECOVERY OF MAGNESIA FROM OIL SHALE

[75] Inventor: Robert A. Hard, Laguna Beach, Calif.

[73] Assignee: Occidental Research Corporation, Irvine, Calif.

[21] Appl. No.: 14,007

[22] Filed: Feb. 21, 1979

[51] Int. Cl.[3] ..... E21C 41/10; E21B 43/28

[52] U.S. Cl. ..... 299/2; 299/4; 208/11 R; 75/101 R

[58] Field of Search ..... 299/2, 4, 5; 75/101 R; 23/304; 423/165, 166; 208/11 R; 166/271, 303, 307

[56] References Cited

U.S. PATENT DOCUMENTS

| | | | |
|---|---|---|---|
| 3,455,796 | 7/1969 | Crumb | 423/165 X |
| 3,915,234 | 10/1975 | Pelofsky | 166/307 |
| 4,068,719 | 1/1978 | Clampitt et al. | 166/307 X |
| 4,103,742 | 8/1978 | Swanson | 166/307 X |

*Primary Examiner*—Ernest R. Purser

*Attorney, Agent, or Firm*—Arnold Grant

[57] ABSTRACT

A fragmented permeable mass of formation particles containing oil shale and carbonates of calcium and magnesium is formed in an in situ oil shale retort. A combustion zone is advanced through the fragmented mass, whereby kerogen in oil shale in the fragmented mass is decomposed in a retorting zone on the advancing side of the combustion zone to produce gaseous and liquid products including shale oil. The combustion zone also converts the magnesium values in the particles of retorted oil shale to a more leachable form such as magnesium oxide. Magnesium values are selectively leached from the combusted particles, with respect to calcium compounds, with an aqueous solution of a purgeable, acid-forming gas such as carbon dioxide and a minor amount of a polyelectrolyte such as polyacrylic acid, polysulfonic acid, polyphosphonic acid, or the salts thereof. An enriched solution containing magnesium values is withdrawn from the fragmented mass and magnesia is recovered from such enriched solution.

42 Claims, 2 Drawing Figures

RECOVERY OF MAGNESIA FROM OIL SHALE

BACKGROUND

Figure 1:
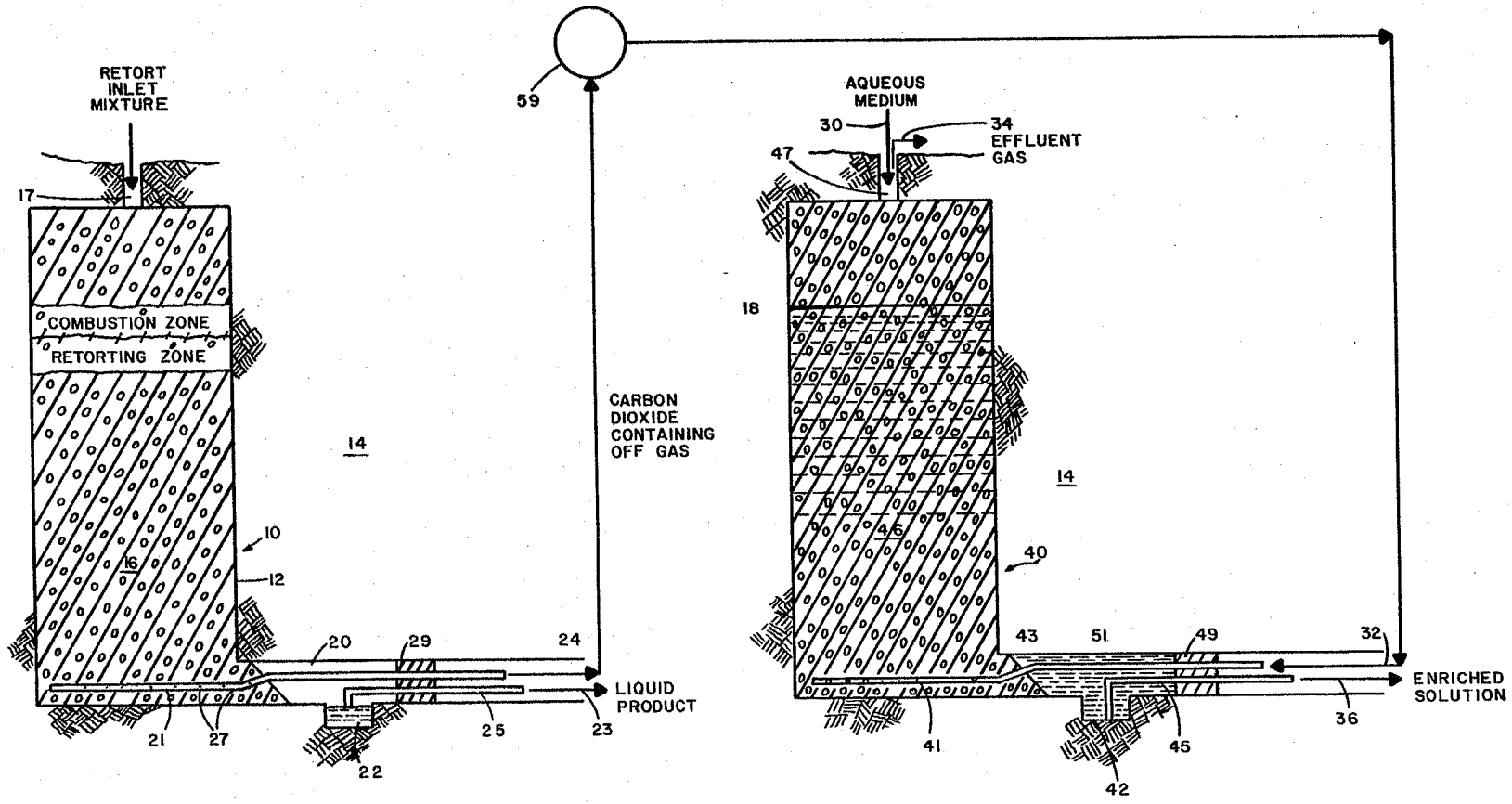

This application is related to U.S. patent application Ser. No. 871,367 filed Jan. 23, 1978 by Hard and U.S. patent application Ser. No. 13,437 filed 2-21-79 both of which applications are assigned to the assignee of this application. The subject matter of these applications is hereby incorporated by this reference.

The selective leaching of magnesium values from spent oil shale retorts is known and described in the aforementioned related patent applications.

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of method have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

Although the process disclosed herein for selectively leaching magnesium values from combusted oil shale is primarily discussed in relation to leaching in an in situ oil shale retort, the process can be practiced on spent oil shale produced by other methods of retorting. Many of these methods for shale oil production are described in *Synthetic Fuels Data Handbook,* compiled by Dr. Thomas A. Hendrickson and published by Cameron Engineers, Inc., Denver, Colo. For example, other processes for retorting oil shale include those known as the Tosco, Paraho Direct, Paraho Indirect, N-T-U, Union Oil, and Bureau of Mines, Rock Springs, processes. Oil shale can also be processed by a combination of such techniques whereby a portion of the oil shale is excavated to create void space underground and retorted above ground, and another portion is explosively expanded toward such void spaces to form in situ retorts for underground retorting.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented peameable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing gaseous combustion zone feed to advance the combustion zone through the retort. In the combustion zone oxygen in the combustion zone feed is depleted by reaction with hot carbonaceous materials to product heat and combustion gas. The combustion zone is maintained at a temperature lower than the fusion temperature of oil shale, which is about 2100° F., to avoid plugging of the retort, and above 1100° F. for efficient recovery of hydrocarbon products from the oil shale.

The effluent gas from the combustion zone comprises combustion gas, carbon dioxide from mineral carbonate decomposition, and any gaseous portion of the combustion zone feed that does not take part in the combustion process. This effluent gas is essentially free of free oxygen and contains constituents such as oxides of carbon, water vapor, nitrogen, and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, including shale oil, together with water produced in or added to the retort, are collected at the bottom of the retort and withdrawn to the surface through an access tunnel, drift or shaft. An effluent gas, referred to herein as off gas, containing combustion gas generated in the combustion zone, gaseous products including methane produced in the retorting zone, carbon dioxide from carbonate decomposition, and any gaseous portion of the combustion zone feed that does not take part in the combustion process is also withdrawn from the bottom of the retort.

Inorganic carbonates can be present in oil shale, notably carbonates of magnesium and calcium which decompose endothermically when heated to their decomposition temperatures. For example, oil shale particles in an in situ retort can contain approximately 8 to 12 weight percent calcium and 1.5 to 3 weight percent magnesium present as carbonates. Carbonate of magnesium is widely distributed in both dawsonitic and non-dawsonitic oil shales in the Piceance Creek Basin and can be a significant source of magnesia, given practical techniques for recovery of the magnesium values.

Magnesium carbonate can be present initially in the formation in a variety of mineral forms of varying composition, such as magnesite or brucite; in association with calcium carbonate as dolomite, a calcium magnesium carbonate; with iron as ferroan, an iron magnesium carbonate; and with calcium and iron as ankerite, a form of dolomite in which there is about 15 percent iron substituted for Magnesium. In stoichiometric dolomite, there is one magnesium atom per calcium atom. Calcium-rich dolomites having ratios of magnesium to calcium of less than one also occur. The aforementioned mineral forms, and others including illite, dawsonite, analcime, aragonite, calcite, quartz, potassium feldspar, sodium feldspar, nahcolite, siderite, pyrite, and fluorite, have been identified by x-ray diffraction analysis. The presence of such mineral forms in oil shale has been reported in W. Rob et al., "Mineral Profile of Oil Shales in Colorado Core Hole No. 1, Piceance Creek Basin, Colorado", *Energy Resources of the Piceance Creek Basin, Colorado*, D. Keith Murry, Ed. Rocky Mountain Association of Geologists, Denver, Colorado, pages 91–100, (19074) and E. Cook, "Thermal Analysis of Oil Shales", *Quarterly of the Colorado School of Mines*, Vol. 65, pages 133–140 (1970), the disclosures of which are incorporated herein by this reference.

U.S. Pat. No. 4,036,299 to Cha, et al, assigned to the assignee of the present application and incorporated herein by this reference, describes a method of recovering shale oil from oil shale in an in situ oil shale report in which a combustion zone is advanced through a fragmented permeable mass of formation particles containing oil shale and carbonates of magnesium and calcium. The patent discloses that the combustion zone is maintained at a temperature of from about 1100° F. to about 1400° F. (593°–760° C.), preferably from about 1200° F. to about 1300° F. (649°–704° C.), to obtain shale oil while avoiding excessive dilution of gaseous retorting products with carbon dioxide from decomposition of inorganic carbonates, notable calcium carbonate, in the oil shale.

Above-mentioned U.S. Pat. No. 3,661,423 to Garrett discloses briefly that mineral values can be leached from retorted oil shale in an in situ oil shale retort with water, acidic, or alkaline leaching agents. However, there is no description of the selective recovery of magnesium values from combusted oil shale in an in situ oil shale retort.

A number of patents have described the recovery of aluminum values from dawsonitic oil shale retorted above ground or by advancement of a combustion zone through an in situ oil shale retort, by leaching with aqueous leaching agents. Exemplary of these are U.S. Pat. Nos. 3,502,372 to Prats, 3,516,787 to Van Nordstrand, 3,572,838 to Templeton, 3,510,255 to Hall et al., and 3,642,433 to Dyni. The leaching agent typically is water or an alkaline aqueous solution, although the use of dilute acids has also been mentioned. The Van Norstrand patent states that oil shale can contain from about 10 to 40 weight percent dolomite, and that dolomite in oil shale is decomposed upon retorting to form carbon dioxide, calcite, and magnesium oxide, the magnesium oxide tying up part of the silica in the oil shale to permit higher recovery of the aluminum values by leaching. Recovery of magnesium values is not disclosed in these patents.

The recovery of magnesium values from ground, calcined dolomite, a mineral form of calcium magnesium carbonate, is known. The selective leaching of magnesium values from dolomite calcined at 750°–850° C. with carbonated water has been described, for example, in U.S. Department of the Interior, Bureau of Mines Technical Paper 684, "The Bicarbonate Process for the Production of Magnesium Oxide", by H. A. Doerner et al (1946), the disclosure of which is incorporated herein by this reference. This paper describes the leaching of magnesium values from slurries of finely ground, calcined dolomite in well agitated mixing tanks.

The thermal decomposition of carbonates of magnesium and calcium in oil shale is described in E. J. Jukkola et al, "Thermal Decomposition Rates of Carbonates in Oil Shale", Industrial and Engineering Chemistry, 45 (1953), 2711–2714, which is incorporated herein by this reference. Data obtained by heating oil shale over a range of temperatures under various partial pressures of carbon dioxide are reported. Leaching of magnesium values from retorted oil shale is not described.

U.S. Pat. No. 3,455,796 to Crumb relates to a method for treating residual material from oil shale retorting for recovery of its magnesium content to form magnesium chloride. Crushed oil shale residue is mixed with water and calcium hydroxide if needed to establish a pH of about 10 or higher. The resulting slurry comprises mineral hydrates including magnesium hydroxide, calcium hydroxide and finely divided unreacted particles. The separated slurry is introduced into a primary carbonation stage with a suitable source of carbon dioxide. The carbonation rate is slow enough to assure that calcium carbonate is formed with minimum formation of magnesium carbonate. The slurry is treated in a secondary carbonation stage with additional carbon dioxide and liquid containing magnesium chloride solution to increase calcium carbonate formation. Hydrochloric acid is introduced to neutralize the discharge from the second carbonation to a final pH of about 7.8. Acid is introduced at a slow rate so that magnesium hydrate dissolves without dissolving calcium carbonate to form a solution containing dissolved magnesium chloride.

SUMMARY OF THE INVENTION

When particles of combusted oil shale are contacted with carbonated and/or sulfonated water at low liquid to solid ratios, e.g., about two, some magnesium values are leached, but the rate of leaching can prematurely fall off, sometimes almost to zero. It appears that a mineral crystal barrier can form during leaching on or within the particles and interfere with further leaching. Observation of particles with a scanning electron microscope has confirmed that crystal growth or scaling can occur on or near the surfaces of the particles during leaching at low liquid to solid ratios. At least a portion of such crystals appear upon visual inspection to the gypsum. Without intending to be bound by a particular theory, it is hypothesized that calcium minerals initially dissolve in the leaching agent and reach saturation, and calcium minerals of low solubility in the acidic aqueous leaching agent crystallize out of solution upon the particles being leached to form a barrier that retards or halts diffusion of leaching agent into and out of the particles.

The formation of such a barrier is especially disadvantageous when particles in an in situ retort are being leached because the weight average effective diameter of the particles is relatively large, e.g., about 2 inches, and a substantial proportion of the particles can have effective diameters greater than 18 inches. Leaching of combusted oil shale in an in situ retort is effective because, among other reasons, the particles are permeable and therefore have a very high effective surface area available for leaching. A mineral crystal barrier near the outer surfaces of the particles can retard or prevent leaching agent from entering the interior of the particles. As a result, leaching can be slowed to an impractical rate or even halted. Such an effect has been observed in laboratory leaching tests using $\frac{1}{8}$ inch to $\frac{1}{4}$ inch particles of combusted oil shale.

Leaching conditions in an in situ oil shale retort are inherently characterized by low weight ratios of liquid to solid because the void fraction, i.e., the fraction of the total volume of the fragmented mass attributable to voids and interstices between and among the particles is on the order of about 10 to 30 volume percent. Thus, the volume of liquid that an in situ oil shale retort can hold is limited. Even though particles containing combusted oil shale have a porosity on the order of 20 to 35 percent by volume, at least a portion of which is permeable, and can absorb substantial quantities of water, the weight ratio of liquid to solid in such an in situ retort during leaching is generally less than one to one. Such ratios can be lower than about one half to one, even when the fragmented mass in the retort is substantially flooded with leaching agent. Liquid to solid ratios in in situ leaching of combusted oil shale are therefore relatively low compared with, for example, liquid to solid ratios for above-ground leaching of slurries in agitated tanks, in which the liquid to solid weight ratio can be greater than one, e.g., five to one, ten to one, or higher.

Application Ser. No. 871,367 teaches combustion temperature control and application Ser. No. 13,437 teaches a two step leaching process comprising a first step of a minor proportion of sulfur dioxide included with carbon dioxide in the aqueous leaching agent and a second step of leaching in the substantial absence of sulfur dioxide as methods for preventing formation of undesirable quantities of calcium oxide in the formation particles. Nevertheless, some quantities of calcium oxides may form despite the aforementioned measures due to lengthy periods at high temperature encountered in field retorting conditions. Such conditions tend to favor endothermic chemical reactions over relatively lengthy periods of time. The present invention provides a method for maintaining permeability of the combusted particles to acidic aqueous leaching agents.

The present invention provides a method for recovering shale oil and magnesium values from a fragmented mass of particles containing oil shale and magnesium values. More particularly, such particles are retorted either above ground or in an situ retort by advancing a combustion zone through the fragmented mass for decomposing kerogen in the oil shale in a retorting zone on the advancing side of the combustion zone to produce gaseous and liquid products, including shale oil, and for coverting magnesium values to a more leachable form, such as magnesium oxide.

According to the present invention, the magnesium values are selectively leached, from the particles, after advancement of the combustion zone through the fragmented mass, with an acidic aqueous leaching agent, such as an aqueous solution of carbon dioxide, sulfur dioxide, or mixtures thereof, containing a minor proportion, relative to the presence of the gaseous leaching agent, of a polyelectrolyte to inhibit deposition of calcium salts on or near the surfaces of the particles. As used herein the term polyelectrolyte is intended to embrace polymers that can carry positive or negative type groups along the polymer chain. The basic leaching process may be performed in either the single step of application Ser. No. 871,367 or the two step method of application Ser. No. 13,437. Preferably the polyelectrolyte is added to the leaching solution throughout the leaching process. Preferred concentrations for the polyelectrolytic are from about 10 to about 500 ppm; and, exemplary polyelectrolytes include polyacrylic acids and salts, polysulfonic acids and salts, and polyphosphonic acids and salts. Mixtures of polyelectrolytes can also be used.

DRAWINGS

Figure 2:
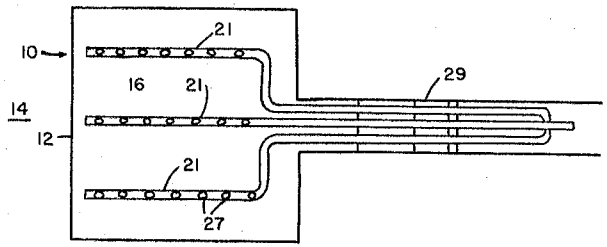

FIG. 1 illustrates in schematic cross section an active in situ oil shale retort undergoing retorting and a spent retort undergoing leaching, off gas from the active retort being introduced to the spent retort for supplying carbon dioxide for leaching; and, FIG. 2 shows a placement of pipes at the base of a retort in FIG. 1 for withdrawing off gas during retorting and introducing carbon dioxide containing gas during leaching.

INTRODUCTION

Description

The process of this invention can be practiced in two distinct but interrelated phases. In the first phase oil shale is fragmented, retorted and combusted to produce combusted oil shale particles in which magnesium values are in a more leachable form than in raw or unretorted oil shale. The second phase involves leaching a mass of such particles with an acidic aqueous leachant containing dissolved carbon dioxide to selectively leach magnesium values from combusted oil shale. The description sometimes blends the two phases as an aid to understanding. A substantial portion of the description of the retorting phase concerns in situ retorting since the long time at elevated temperature in such a process and the inherent low liquid to solid ratios during leaching in situ can complicate subsequent leaching.

In an above ground retorting process mine-run oil shale is crushed in small particle size and then heated to retorting temperature to recover liquid and gaseous products. The retorted oil shale contains carbonaceous residue. This residue is burned to produce heat for retorting and results in combusted oil shale. The combustion zone can be passed through a mass of retorted oil shale, or the combustion zone can remain in a substantially constant location and a mass of retorted oil shale passed through it. The retorting and combustion zones can be in the same or different vessels depending on the process employed.

In an in situ process a fragmented permeable mass of formation particles containing oil shale in an in situ oil shale retort is formed in a subterranean formation containing oil shale. Referring briefly to FIG. 1, a combustion zone is advanced through the fragmented mass 16 in an in situ retort 10 by introducing an inlet mixture through conduit 17 and withdrawing an off gas through a drift 20 by means of perforated pipes 21. Kerogen in oil shale in a retorting zone on the advancing side of the combustion zone is decomposed to produce gaseous and liquid products which are withdrawn through the drift 20, and retorted particles containing residual carbon. Residual carbon supports combustion in the combustion zone.

Particles combusted at maximum temperatures less than about 900° C. contain magnesium values in a form, e.g., magnesium oxide or magnesium hydroxide, that is readily leachable with an aqueous solution of carbon dioxide. Combusted particles can also contain other oxides, notably calcium oxide and mineral slags such as akermanite.

In the second phase, magnesium values are leached from the combusted particles in at least a portion of the fragmented mass by contacting the particles with an aqueous medium containing gaseous carbon dioxide and/or sulfur dioxide, which may, for example, be from an active in situ oil shale retort. Conditions of temperature and pressure which favor high concentrations of dissolved gas in the aqueous medium are preferred. The leached, dissolved magnesium carbonate or sulfonate is recovered for further processing into magnesia (MgO) in accordance with known methods.

The second phase may be carried out in either one step, i.e., contacting the fragmented mass of combusted particles with the aqueous acidic medium, or in one step with preconditioning, or in two steps. In one step with preconditioning, the combusted particles in the fragmented mass are first contacted with water or water vapor to hydrate the magnesium values prior to introduction of the leaching agent. Preconditioning can also involve contacting the combusted particles with the gaseous leaching agent to precarbonate or presulfonate oxides in the particles. Leaching is preferably conducted at elevated partial pressures of the gaseous leaching agent. The cost of compressing the gas to achieve these high partial pressures can have a serious impact on the economics of the process. Pregasification, on the other hand, can be accomplished at ambient pressure, thereby reducing pumping costs. Pregasification is also advantageous because it reduces the consumption of gas during leaching which thereby reduces the quantity of gas which must be compressed to elevated leaching pressures.

As stated, the leaching can also be practiced in two steps, both of which leach magnesium values from combusted formation particles with carbonated water. In the first step a small proportion of sulfur dioxide gas is dissolved in the carbonated aqueous leaching agent and an enriched solution containing magnesium values is withdrawn from the retort. In the second step, the introduction of sulfur dioxide in the aqueous leaching agent is discontinued and the leaching is carried out with a carbonated aqueous medium in the substantial absence of sulfur dioxide. An enriched solution of magnesium values and carbon dioxide is also withdrawn from the retort and, as with the product from the first step, treated in accordance with known procedures to form magnesia.

Inasmuch as the preparation and operation of an in situ oil shale retort has been described in the patent literature, for example in said U.S. Pat. Nos. 3,661,423 and 4,036,299, the leaching phase of the method of the present invention will first be discussed in detail.

LEACHING PHASE

After advancement of the combustion zone through the fragmented mass, the fragmented mass contains magnesium values in forms such as the oxide and the hydroxide which are readily leachable from the fragmented mass with an aqueous solution of an acid forming gas such as carbon dioxide, sulfur dioxide, or mixtures thereof. After retorting and cooling magnesium values are selectively leached from the combusted fragmented mass by contacting particles in the mass with an aqueous solution containing a purgeable, acid-forming gas such as dissolved carbon dioxide, sulfur dioxide or mixtures thereof. It is believed that the aqueous gas carbonates or sulfonates and dissolves the leachable magnesium values. A mechanism for leaching of magnesium oxide, with for example, carbon dioxide can proceed in accordance with the chemical equations:

$$MgO + xH_2O + CO_2 \rightarrow MgCO_3(H_2O)_x' \quad (1)$$

and $$MgCO_3(H_2O)x + CO_2 \rightarrow Mg(HCO_3)_2 + (x-1)H_2O \quad (2)$$

or directly, for example, in accordance with the chemical equation $$MgO + H_2O + 2CO_2 \rightarrow Mg(HCO_3)_2. \quad (3)$$

The $Mg(HCO_3)_2$ is believed to exist in aqueous solution containing dissolved carbon dioxide.

When carbon dioxide is in solution in water, it forms an acidic solution known as carbonic acid. The solution can contain solvated hydrogen ions and solvated bicarbonate ions. It is believed that magnesium bicarbonate can be present in such a solution in equilibrium with bicarbonate ion. When carbon dioxide is removed from such a solution, the concentration of bicarbonate ion drops and magnesium bicarbonate dissociates to form insoluble magnesium carbonate. Regardless of the actual mechanism and regardless of the actual species present in solution, the phrase "containing dissolved carbon dioxide" as it is used herein is intended to include all species, whether ionic or nonionic, which may be formed when gaseous carbon dioxide is dissolved in an aqueous medium. The phrase "containing dissolved sulfur dioxide" is intended to include all species, whether ionic or nonionic, which may be formed when gaseous sulfur dioxide is dissolved in aqueous medium. Similarly, the phrase "containing dissolved magnesium bicarbonate" is intended to include any dissolved form of magnesium in an aqueous solution containing dissolved carbon dioxide which precipitates as magnesium carbonate when carbon dioxide is removed from the solution.

For purposes of the following discussion and exemplification, the invention will be described only with regard to the use of carbon dioxide as the purgeable acid-forming gas. Also for purposes of the following discussion and exemplification, the invention will be described with regard to in situ retorting of oil shale. It should be understood, however, that the invention encompasses the use of carbon dioxide, sulfur dioxide and mixtures thereof and that the invention is equally applicable to above ground methods of retorting oil shale.

When an aqueous solution of carbon dioxide is contacted with retorted, combusted oil shale containing alkaline earth metal oxides such as oxides of magnesium and calcium, the solution becomes enriched with magnesium values, and the pH of the leaching agent can thus be slightly over 7, for example, about 7.2, even when dissolved carbon dioxide is present in the leaching agent. Such a slighly alkaline leaching solution is intended to be included within the meaning of the term "acidic, aqueous leaching agent" as the term is used herein because the dissolved carbon dioxide continues to act as an acid in acid-base reaction with the leachable magnesium values in the oil shale.

Conditions that favor increased concentration of dissolved carbon dioxide or species resulting therefrom in the leaching solution also favor leaching of magnesium values and increased concentration of magnesium values in solution. Briefly, such conditions include low temperature and high pressure, as discussed in greater detail below.

Particles containing combusted oil shale in the cooled fragmented mass are contacted with an aqueous solution of carbon dioxide at temperatures above the freezing point of the solution, preferably in the range of between about 10° C. and 60° C. Such temperatures are preferred for obtaining sufficient concentrations of magnesium values and carbon dioxide in solution for economical recovery. At temperatures substantially above 60° C., the solubility of carbon dioxide and of magnesium values is low. Solution temperatures below about 10° C. in the retort can be difficult to maintain because the leaching is exothermic and the temperature of the leaching solution tends to rise during leaching.

The effective partial pressure of carbon dioxide in at least a portion of the fragmented mass in contact with the aqueous leaching agent is preferably at least about one-half atomosphere, preferably at least about one atmosphere, to provide sufficient dissolved carbon dioxide in the leaching agent. The solubility of the gas increases with increased partial pressure of the gas. The effective partial pressure is the actual partial pressure of carbon dioxide in a gaseous phase in contact with the gaseous leaching agent containing dissolved carbon dioxide in the fragmented mass or the partial pressure of carbon dioxide in a gas phase which would be in equilibrium when in contact with such aqueous leaching agent containing dissolved carbon dioxide. Effective partial pressures of carbon dioxide below about one-half atmosphere can result in a low recovery of magnesium values because of the low concentration of magnesium values in the enriched solution withdrawn from the retort.

Previous laboratory studies of leaching of mineral values from dolomite particles have typically involved calcining times on the order of several hours to at most a week. Yet, under actual field conditions, overall reaction times of an oil shale retort can be on the order of 100 days. The length of the retorting and combustion process promotes formation of mineral compounds which have very low kinetic rate constants. Such compounds will not normally appear under laboratory conditions, because laboratory time scales have been too short to permit appreciable formation of compounds with low kinetic rate constants.

One such compound present in appreciable quantities in the combusted particles in calcium oxide which can inhibit the leaching of magnesium values. It is believed that carbonation of calcium oxide, to reform calcium carbonate, can create a barrier in or on the oil shale particles which prevents penetration of the aqueous leaching agent into the interiors of the combusted particles. Reformation of calcium carbonate, which is relatively insoluble in carbonated water, effectively decreases the permeability of the combusted particles to the aqueous leaching agent. Thus, the leaching of magnesium values from the combusted particles is inhibited under conditions which promote the recarbonation of calcium oxides during leaching. Conversely, it has been discovered that inhibiting the recarbonation of calcium oxide during leaching will improve the overall leaching of magnesium values.

The incorporation into the aqueous leaching fluid of a minor proportion, relative to the amount of carbon dioxide, of one or more polyelectrolytes have been found to inhibit deposition of calcium salts on or near the surfaces of the combusted particles. Although not fully understood, it is believed that the polyelectrolyte inhibits such deposition by a combination of two mechanisms. First, the polyelectrolyte inhibits nucleation of calcium carbonate into crystals. Second, the polyelectrolyte disorients any crystals which may form, softening them sufficiently to allow penetration by the leaching agent. As used herein, the term polyelectrolyte is intended to embrace polymers that can carry positive or negative type groups along the polymer chain.

The amount of polyelectrolyte found useful for purposes of the present invention is from about 10 ppm to about 500 ppm, preferably from about 50 ppm to about 250 ppm and most preferably from about 75 ppm to about 150 ppm. Polyelectrolytes found particularly suitable for the present invention include polyacrylic acids and salts, polyphosphonic acids and salts and polysulfonic acids and salts and mixtures thereof. Preferably the polyelectrolyte is present in the above concentrations in the leaching fluid throughout the leaching operation.

For economy, the conduit means 17 used for introducing an inlet mixture to the retort 10 during the retorting operation can be used for introducing carbon dioxide containing solution to the retort or for withdrawing effluent solution from the retort. Similarly, the pipe or pipes 21 or other means used for withdrawing off gas from the retort during the retorting operation can be used for introducing carbon dioxide containing solution to the retort or for withdrawing effluent solution from the retort.

Trickle leaching or flood leaching can be used for contacting particles in the cooled fragmented mass with the aqueous solution of carbon dioxide. In trickle leaching, particles in the fragmented mass are wetted with leaching agent that flows downwardly through the mass, but the void spaces between particles in the mass are largely occupied by gas. In flood leaching, the void spaces are largely occupied by liquid leaching agent, and the leaching agent can flow upwardly, downwardly, or laterally through the fragmented mass.

With either trickle leaching or flood leaching, aqueous solution can be formed outside of the retort and can then be introduced to the fragmented mass in the retort. Carbon dioxide and/or sulfur dioxide can be dissolved in aqueous medium, such as water or an aqueous recycle stream from leaching operations, at ambient pressure or higher pressures and the resultant aqueous solution can be introduced into the retort at ambient or higher pressures. Because the solubility of a gas in a liquid is higher at lower temperatures, the solution is preferably prepared at leaching temperatures or lower, for example, at temperatures in the range of about 10° to 60° C. or lower, and preferably at pressures at least as high as the highest pressure in the retort during leaching. The carbon dioxide can be commercial carbon dioxide, e.g., from cylinders or solid carbon dioxide, or carbon dioxide in off gas, burned off gas, tail gas from combustion of fuel, or kiln gas obtained in the calcining of magnesium carbonate to produce magnesia, as described below. Mixtures of such gases can be used.

The sulfur dioxide can be from commercial gases, or from combustion of sulfur or hydrogen sulfide. Sufficient amounts of sulfur dioxide can be present in some combustion flue gas streams. Off gas from an in situ oil shale retort can contain hydrogen sulfide gas. Such hydrogen sulfide gas can be treated by known methods, such as passing it through an amine scrubber, containing monoethanol amine or diethanol-amine for concentrating the hydrogen sulfide which is then converted to sulfur dioxide. Such converted sulfur dioxide can be dissolved in aqueous medium for introduction to the combusted particles or it can be introduced to the fragmented mass as gaseous sulfur dioxide.

In an embodiment of the present invention, the cooled fragmented mass in an in situ oil shale retort is substantially flooded with downwardly flowing aqueous medium, and carbon dioxide containing gas and a minor proportion of a polyelectrolyte such as polyacrylic acid are introduced near the bottom of the fragmented mass. An enriched solution containing magnesium values is withdrawn from the fragmented mass at the bottom of the retort. Referring again to FIG. 1, aqueous medium 30 is introduced to a fragmented mass of particles 46 containing combusted oil shale in an in situ oil shale retort 40 through the conduit 47 and substantially floods at least a portion of the fragmented mass, for example, the portion of the fragmented mass below a liquid level indicated at line 18. A sealing bulkhead 49 in the lower drift 51 holds the liquid in the retort.

The introduced aqueous medium 30 flows downwardly through the fragmented mass 46 and contacts particles therein. Carbon dioxide containing off gas 24 is withdrawn from the active retort 10, is compressed in compressor 59, is introduced through line 32 and gas introduction means 41 to the fragmented mass 46, and flows upwardly through the mass. Carbon dioxide from the gas dissolves in the aqueous medium and reacts with leachable magnesium values in the fragmented mass. Continued introduction of cabon dioxide containing gas and the polyelectrolyte replenishes the concentration of dissolved carbon dioxide in the aqueous medium for dissolving magnesium values and holding dissolved magnesium values in solution.

As aqueous medium flows downwardly through the fragmented mass, it becomes enriched with magnesium values, carbon dioxide, and also dissolved water soluble materials such as sodium salts and sulfates. Magnesium values are selectively dissolved with respect to calcium minerals, which to a great extent remain behind as insoluble calcium compounds such as calcium carbonate; substantially insoluble silicates, which are present in the raw shale or are formed during retorting; and other minerals, such as akermanite and aluminum compounds, that are relatively insoluble in carbonated water.

Pressure at the bottom of the retort can be high owing to the hydrostatic head of liquid in the retort. In flood leaching, pressures as high as 10 to 15 atmospheres above ambient or higher can be encountered at the bottom of the retort, depending upon the height of the column of liquid in the retort. The effective partial pressure of carbon dioxide can be as high as the total pressure, when pure carbon dioxide gas is used, or lower. When a carbon dioxide containing gas is used, the effective partial pressure of carbon dioxide depends upon the concentration of carbon dioxide in the gas. The effective partial pressure of carbon dioxide is preferably at least about one atmosphere at the bottom of the retort when flood leaching with downwardly flowing leaching agent is used, although it can be lower at higher elevations within the retort where hydrostatic pressure can be lower.

The size and distribution of sizes of particles in the fragmented mass can affect the rate of leaching and the recovery of magnesium values. The fragmented mass can have a wide distribution of particle sizes. In situ oil shale retorts formed in accordance with the disclosures of U.S. Pat. Nos. 3,661,423; 4,043,595; 4,043,596; 4,043,597; and 4,043,598, incorporated herein by this reference, are suitable for recovery of shale oil and magnesium values in accordance with this invention. The fragmented mass of formation particles can have the greater part of its weight, i.e., greater than 50 percent of its weight, in particles having average effective diameters above about 2 inches. For example, an in situ oil shale retort in the Piceance Creek Basin of Colorado prepared by explosive expansion of formation toward a void is though to contain a fragmented permeable mass consisting of about 58% by weight particles having a weight average effective diameter of 2 inches, about 23% by weight particles having a weight average diameter of 8 inches, and about 19% by weight particles having a weight average diameter of 30 inches.

Enriched solution 36 containing magnesium values is withdrawn from the bottom of the retort 40 through the drift 51. At least a portion of the enriched solution can be withdrawn though a pipe means 45 that passes through the bulkhead of 49 and terminates in a sump 42. The enriched solution contains dissolved magnesium bicarbonate, dissolved carbon dioxide, and minor amounts of dissolved impurities. When the enriched solution is withdrawn, it is at the pressure prevailing at the bottom of the retort and contains dissolved carbon dioxide at a sufficient partial pressure to maintain the dissolved magnesium bicarbonate in solution.

The pressure of the enriched solution withdrawn from a retort undergoing flood or trickle leaching is lowered to about ambient pressure or lower for precipitating magnesium values. Dissolved carbon dioxide comes out of solution as carbon dioxide gas. As carbon dioxide comes out of solution, the solubility of the magnesium bicarbonate decreases; and hydrated magnesium carbonate precipitates from solution. The carbon dioxide can be recovered and reused for precarbonating or leaching.

Because carbon dioxide readily comes out of aqueous solution when the pressure is lowered or the temperature is raised, it is referred to herein as "purgeable acid-forming gas", indicating that the carbon dioxide can be purged from the enriched solution withdrawn from the retort for precipitation of magnesium values. Sulfur dioxide is also a purgeable acid-forming gas. When carbon dioxide and sulfur dioxide are combined in the proper proportions, recovery of magnesium values is improved.

The precipitation of magnesium carbonate can be accomplished in a variety of ways. For example, enriched solution withdrawn from the retort can be introduced to a settling pond oil tank where carbon dioxide passes into the atmosphere and magnesium carbonate precipitates. Enriched solution can be sprayed over the pond or otherwise aerated to speed the removal of carbon dioxide. The temperature of the solution can be raised to lower the solubility of carbon dioxide. Techniques for precipitating magnesium carbonate from aqueous solutions of carbon dioxide and magnesium bicarbonate are described in the above mentioned Bureau of Mines Technical Paper 684.

When sufficient carbon dioxide has been removed, a slurry of precipitated hydrated magnesium carbonate in a barren solution is obtained. The barren aqueous solution can contain as little as 0.1 percent magnesium values calculated as MgO. As much as 95 percent of the magnesium values in the enriched solution can be precipitated.

Precipitated magnesium carbonate is filtered from the barren solution, dried, and calcined in kilns to magnesia as described in aforementioned Bureau of Mines Technical Paper 684. Barren solution can be recycled to the same retort or a different retort for further leaching of magnesium values.

Heat for warming enriched solution for precipitating magnesium carbonate can be obtained from a number of sources. Off gas from an operating in situ oil shale retort can have a temperature of up to about 50° C. or more and can contain substantial quantities of water vapor. Such off gas can be used to heat enriched solution, either by direct contact with the solution or by indirect contact through a heat exchanger. Off gas that is passed through enriched solution at ambient pressures or lower and ambient temperature or higher can remove carbon dioxide from the solution. Such carbon dioxide enriched off gas is useful for the precarbonation or leaching in accordance with this invention. Heat can be obtained from a hot, spent retort by passing as gas through such a retort.

When wet, precipitated basic magnesium carbonate is calcined, the resultant hot kiln gas contains steam and carbon dioxide. Such kiln gas can be used as a source of heat for removing carbon dioxide from enriched solution, and as carbon dioxide containing gas for precarbonating particles in a retorted retort and for leaching magnesium values therefrom.

Because control of maximum temperature in the combustion zone advancing through a retort during retorting is important for obtaining good results during a subsequent leaching operation, the retorting phase is detailed below.

RETORTING PHASE

Referring again to FIG. 1, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. Methods of forming an in situ oil shale retort are described in U.S. Pat. Nos. 3,661,423; 4,043,595; 4,043,596; 4,043,597 and 4,043,598. A variety of other techniques can also be used.

A conduit 17 communicates with the top of the fragmented mass of formation particles, or a plurality of conduits 17 can be used. During the retorting operation of the retort 10, a combusion zone is established in the retort by ignition of carbonaceous material in oil shale in the fragmented mass. The combustion zone is advanced through the fragmented mass by introducing an oxygen containing retort inlet mixture into the in situ oil shale retort through the conduit 17 as a combustion zone feed. Oxygen introduced to the retort inlet mixture oxidizes carbonaceous material in the oil shale to produce combustion gas.

Combustion gas produced in the combustion zone and any unreacted portion of the combustion zone feed pass through the fragmented mass of particles on the advancing side of the combustion zone to establish a retorting zone on the advancing side of the combustion zone. Kerogen in the oil shale is retorted in the retorting zone to produce liquid products including shale oil and gaseous products including combustible gaseous products.

There is an access tunnel adit, drift 20 or the like in communication with the bottom of the retort. The drift contains a sump 22 in which liquid products 23, including shale oil and water, are collected to be withdrawn. A network of gas withdrawal means or pipes 21 is provided at the base of the fragmented mass for withdrawal of off gas. An off gas 24 containing gaseous products, combustion gas, carbon dioxide from carbonate decomposition, and any gaseous unreacted portion of the combustion zone feed, is also withdrawn through pipe means 21 and drift 20 through a bulkhead or sealing means 29. The pipe means 21 can include perforations 27 in the sides which can be of graduated size along the length of the pipes to provide uniform gas flow across the retort, as described in U.S. Pat. No. 3,941,421, the disclosure of which is incorporated herein by this reference.

The maximum temperature of particles in the fragmented mass is controlled, during advancement of the combustion zone through the fragmented mass, in a range of temperature sufficient for converting magnesium values in the oil shale to a form that is more leachable with an aqueous solution of carbon dioxide and below a temperature at which leachable magnesium values are converted to a less leachable mineral form, for example, a maximum temperature in the range of about 600° F. to about 900° F. Preferably the maximum temperature is less than about 730° C. for improved leaching. The maximum temperature ca be controlled by monitoring the temperature of the combustion zone, and regulating the composition of the combustion zone feed for controlling the combustion zone temperature. The concentration of oxygen, the concentration of diluent such as steam or recycled off gas, the concentration of added fuel, and the flow rate of the combustion zone feed can all be varied for controlling the maximum temperature in the combustion zone.

The following examples further illustrate the present invention.

EXAMPLE I

A glass column was filled with 0.67 kg of combusted oil shale having a particle size range of from about $\frac{1}{8}$" to about $\frac{1}{4}$" and an average particle size of 3/16". 1.1 Liters of water at ambient temperature was circulated through the column and $CO_2$ was introduced into the bottom of the column until the water was saturated. Fifteen grams or approximately 50 ppm, based on the water, of a 33% active, 70% neutralized sodium salt of low molecular weight polyacrylic acid with a pH of 5.0–5.4, a specific gravity at 60° F. of 1.180, a freeze point of 25°–30° F. and a viscosity at 77° F. (Hoeppler) of 15–20 cps was added to the solution and measurements taken over time of the concentration of dissolved magnesium ($Mg++$) in the solution. The results were:

| Time (Hours) | Concentration (grams/liter) |
|---|---|
| 2 | .394 |
| 25 | 3.005 |
| 42.5 | 4.318 |
| 91.0 | 5.076 |
| 162.0 | 5.106 |

EXAMPLE II

The same conditions as in Example I, except the concentration of the polyacrylate was increased to 100 ppm.

| Time (Hours) | Concentration (grams/liter) |
|---|---|
| 1.0 | .204 |

-continued

| Time (Hours) | Concentration (grams/liter) |
|---|---|
| 24.0 | 2.947 |
| 42.0 | 4.522 |
| 90.0 | 5.324 |
| 162.0 | 5.339 |
| 193.0 | 5.237 |
| 214.0 | 5.295 |
| 231.0 | 4.858 |

EXAMPLE III

The same conditions as in Example I except the concentration of the polyacrylate was increased to 500 ppm.

| Time (Hours) | Concentration (grams/liter) |
|---|---|
| 2.0 | .438 |
| 25.0 | 2.947 |
| 42.0 | 4.318 |
| 91.0 | 5.164 |
| 162.0 | 5.149 |
| 194.0 | 4.799 |
| 212.0 | 4.639 |

EXAMPLE IV

The same conditions as in Example I except no polyacrylate was in the solution.

| Time (Hours) | Concentration (grams/liter) |
|---|---|
| 71 | 3.479 |
| 456 | 3.048 |

It can thus be seen from a comparison of the results in Examples I–III and IV that the presence of a polyelectrolyte dramatically reduces the leaching time and the total concentration of leached magnesium. It is also interesting to note that without the presence of the polyelectrolyte in the leach solution, the concentration of magnesium decreased over time.

Modifications and variations of the above described embodiments can be made without departing from the scope of the present invention. For example, a plurality of spent retorts can be leached simultaneously, with carbon dioxide containing off gas from the active retorts being introduced into the spent retorts for leaching mangesium values. For flowing liquid or gas laterally through a fragmented mass or a portion thereof, vertical shafts can be drilled into the fragmented mass near the sides of the retort, and fluid can be introduced through at least one such shaft and be withdrawn from at least one other such shaft laterally spaced from the first shaft.

The principles of the present invention can also be employed for recovering magnesium values from oil shale that has been retorted above ground for producing gaseous and liquid products including shale oil and has been heated to maximum temperatures, e.g., temperatures in the range of about 600° to about 900° C., sufficient for converting magnesium values in such shale to a form that is leachable of magnesium values from carbonated water. The retorting and heating can be done in one step or in separate ceramic balls; by combustion of carbonaceous values in the particles; or by combinations of such methods. Such retorted heated particles are contacted with an aqueous solution containing sufficient dissolved carbon dioxide for leaching magnesium values from the particles and for forming enriched solution containing such magnesium values. Such enriched solution is separated from the particles, and magnesium values are recovered from the enriched solution.

Although the present invention has been described with reference to particular details and embodiments thereof, the particulars are not intended to limit the invention, the scope of which is defined in the following claims:

What is claimed is:

1. A method for recovering shale oil and leaching magnesium values from formation particles in an in situ oil shale retort in a subterranean formation containing oil shale and magnesium values which comprises:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

selectively leaching magnesium values from at least a portion of the fragmented mass by contacting particles in the fragmented mass with an acidic aqueous leaching agent containing a minor amount of a polyelectrolyte for forming enriched solution containing magnesium values;

withdrawing enriched solution containing magnesium values from the retort; and recovering magnesium values from such enriched solution.

2. A method as recited in claim 1 wherein the polyelectrolyte is selected from the group consisting of polyacrylates, polyacrylic acid, polysulfonates, polysulfonic acid, polyphosphonates, polyphosphonic acid and mixtures thereof.

3. A method as recited in claim 1 in which the leaching agent contains sufficient dissolved carbon dioxide for forming enriched solution containing dissolved magnesium bicarbonate.

4. A method as recited in claim 1 wherein the concentration of polyelectrolyte in the leach solution is from about 10 ppm to about 500 ppm.

5. A method as recited in claim 1 in which particles in the fragmented mass are contacted with the leaching agent at temperatures in the range of from about 10° C. to 60° C.

6. A method as recited in claim 1 wherein the concentration of polyelectrolyte in the leach solution is from about 50 ppm to about 250 ppm.

7. A method as recited in claim 1 comprising the step of contacting at least a portion of the fragmented mass with aqueous liquid and introducing carbon dioxide containing gas to the portion of the fragmented mass in contact with the aqueous liquid.

8. A method as recited in claim 1 wherein the concentration of polyelectrolyte is from about 75 ppm to about 150 ppm.

9. A method as recited in claim 7 in which gaseous carbon dioxide is present in at least a portion of the fragmented mass at an effective partial pressure of at least about one-half atmosphere.

10. A method as recited in claim 1 wherein the leaching agent contains a dissolved gas selected from the group consisting of carbon dioxide, sulfur dioxide and mixtures thereof.

11. A method as recited in claim 2 wherein the polyelectrolyte is polyacrylate.

12. A method as recited in claim 2 in which the polyelectrolyte is polyacrylic acid.

13. A method as recited in claim 10 which comprises trickling the leaching agent downwardly through the fragmented mass.

14. A method as recited in claim 13 which comprises flowing the gas upwardly through the fragmented mass.

15. A method as recited in claim 1 which comprises substantially flooding at least a portion of the fragmented mass with leaching agent and flowing leaching agent downwardly through the flooded portion of the fragmented mass.

16. A method as recited in claim 15 which comprises flowing carbon dioxide containing gas upwardly through the flooded portion of the fragmented mass.

17. A method as recited in claim 16 which comprises the steps of providing at least one perforated pipe near the bottom of the fragmented mass for withdrawing off gas, and introducing the gas to the fragmented mass through such a pipe.

18. A method for recovering shale oil and leaching magnesium values from formation particles in an in situ oil shale retort in a subterranean formation containing oil shale which comprises:

advancing a combustion zone through a fragmented permeable mass of formation particles containing oil shale and magnesium values in an in situ oil shale retort by introducing an oxygen-containing gas to the fragmented mass on a trailing side of the combustion zone and withdrawing an off gas from the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone;

cooling the fragmented mass after advancement of the combustion zone therethrough;

contacting at least a portion of the cooled fragmented mass with an aqueous leaching agent containing sufficient dissolved carbon dioxide and a minor amount, relative to the amount of carbon dioxide, of a polyelectrolyte containing magnesium values;

withdrawing enriched solution containing magnesium values from the fragmented mass; and recovering magnesium values from such enriched solution.

19. A method as recited in claim 18 wherein the polyelectrolyte is selected from the group consisting of polyacrylates, polyacrylic acid, polysulfonates, polysulfonic acid, polyphosphonates, polyphosphonic acid and mixtures thereof.

20. A method as recited in claim 18 wherein the concentration of polyelectrolyte in the leach solution is from about 10 ppm to about 500 ppm.

21. A method as recited in claim 18 wherein the concentration of polyelectrolyte in the leach solution is from about 50 ppm to about 250 ppm.

22. A method as recited in claim 18 wherein the concentration of polyelectrolyte is from about 75 ppm to about 150 ppm.

23. A method as recited in claim 18 wherein the leaching is performed in two discrete steps and in the first a minor amount, relative to the amount of carbon dioxide, of sulfur dioxide is added to the leaching agent.

24. A method as recited in claim 18 in which calcium and magnesium oxides are formed in the fragmented mass during advancement of the combustion zone therethrough and which comprises the step of contacting at least a portion of the fragmented mass after advancement of the combustion zone therethrough and before leaching with a gas comprising sufficient carbon dioxide for reacting with at least a portion of the oxides formed in the fragmented mass.

25. A method as recited in claim 18 comprising the step of contacting at least a portion of the fragmented mass with aqueous liquid and introducing carbon dioxide containing gas to the portion of the fragmented mass in contact with the aqueous liquid.

26. A method as recited in claim 25 which comprises substantially flooding at least a portion of the fragmented mass with leaching agent, flowing leaching agent downwardly through the flooded portion, and flowing carbon dioxide containing gas upwardly through the fragmented mass.

27. In a method for recovering shale oil and leaching magnesium values from formation particles in an in situ oil shale retort in a subterranean formation containing oil shale and magnesium values which comprises: advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached, and selectively leaching magnesium values from at least a portion of the fragmented mass by contacting particles in the fragmented mass with an aqueous leaching agent containing carbon dioxide for forming enriched solution containing magnesium values, withdrawing enriched solution containing magnesium values from the retort and recovering magnesium values from such enriched solution; the improvement comprising:

a two phase process of introducing during at least a first phase of the leaching process sufficient dissolved sulfur dioxide in the aqueous leaching agent for increasing, when combined with the second step, the concentration of magnesium values leached into aqueous solution of carbon dioxide relative to the concentration of magnesium values leached into aqueous solution of carbon dioxide without introduction of sulfur dioxide; thereafter, during a second phase of the leaching process, contacting at least a portion of the fragmented mass with an aqueous leaching agent containing carbon dioxide in the substantial absence of sulfur dioxide; and during at least one of said phases introducing to the aqueous leaching agent a minor amount of a polyelectrolyte.

28. A method as recited in claim 27 wherein the polyelectrolyte is selected from the group consisting of polyacrylates, polyacrylic acid, polysulfonates, polysulfonic acid, polyphosphonates, polyphosphonic acid, and mixtures thereof.

29. A method as recited in claim 27 wherein the concentration of polyelectrolyte in the leach solution is from about 10 ppm to about 500 ppm.

30. A method as recited in claim 27 wherein the concentration of polyelectrolyte in the leach solution is from about 50 ppm to about 250 ppm.

31. A method as recited in claim 27 wherein the concentration of polyelectrolyte is from about 75 ppm to about 150 ppm.

32. A method as recited in claim 27 wherein the first phase comprises the step of contacting at least a portion of the fragmented mass with aqueous liquid and introducing gas containing carbon dioxide and sulfur dioxide to the portion of the fragmented mass in contact with the aqueous liquid.

33. A method as recited in claim 27 which comprises trickling leaching agent downwardly through the fragmented mass.

34. A method as recited in claim 27 which comprises flowing gas containing carbon dioxide and sulfur dioxide upwardly through the fragmented mass.

35. A method as recited in claim 27 which comprises substantially flooding at least a portion of the fragmented mass with leaching agent containing dissolved sulfur dioxide and carbon dioxide and flowing leaching agent downwardly through the flooded portion of the fragmented mass.

36. A method as recited in claim 27 which comprises introducing gas containing carbon dioxide and sulfur dioxide upwardly into the flooded portion of the fragmented mass.

37. A method as recited in claim 27 wherein the polyelectrolyte is polyacrylic acid.

38. A method as recited in claim 27 wherein the polyelectrolyte is a polyacrylate.

39. A method for recovering shale oil and leaching magnesium values from particles containing oil shale and carbonate of magnesium which comprises:

retorting oil shale at a sufficient temperature that kerogen in oil shale is decomposed to produce gaseous and liquid products including shale oil and carbonaceous residue;

burning such carbonaceous residue in a combustion zone at sufficient temperatures for converting at least a portion of the oil shale in the particles to combusted oil shale from which magnesium values can be leached;

contacting at least a portion of the particles of combusted oil shale with an aqueous leaching agent containing a minor amount of a polyelectrolyte for forming an enriched solution containing dissolved magnesium values; and recovering basic magnesium values from such enriched solution.

40. A method for recovering shale oil and leaching magnesium values from particles containing oil shale and carbonate of magnesium which comprises:

retorting such particles for decomposing kerogen in oil shale to produce gaseous and liquid products including shale oil and heating retorted particles at a maximum temperature sufficient for converting oil shale to a form from which magnesium values can be leached;

contacting such retorted heated particles with an aqueous solution containing sufficient dissolved carbon dioxide for selectively leaching magnesium values from the particles and for forming an enriched solution containing such magnesium values, the aqueous solution also containing a minor amount of dissolved sulfur dioxide relative to the amount of carbon dioxide in the solution and a minor amount of a polyelectrolyte;

separating such enriched solution from the particles; and recovering magnesium values from such enriched solution.

41. A method as recited in claim 40 further comprising the steps of:

extracting carbon dioxide and hydrogen sulfide from an off gas from oil shale retorting;

oxidizing such hydrogen sulfide to sulfur dioxide; and dissolving such carbon dioxide and sulfur dioxide for forming the aqueous solution.

42. A method for leaching of magnesium values from combusted oil shale particles comprising the step of contacting combusted oil shale particles with an acidic aqueous leaching agent having a minor portion of a polyelectrolyte for forming enriched solution containing magnesium values.

* * * * *